US005875933A

United States Patent [19]

Ellion et al.

[11] Patent Number: 5,875,933

[45] Date of Patent: Mar. 2, 1999

[54] INVERTIBLE SPRAY DISPENSING CONTAINER

[76] Inventors: M. Edmund Ellion, 3660 Woodstock Rd., Santa Ynez, Calif. 93460; James C. Pfautz, 325 Clopston Hill, Sherwood Forest, Mass. 21405

[21] Appl. No.: 912,140

[22] Filed: Aug. 15, 1997

Related U.S. Application Data

[63] Continuation-in-part of Ser. No. 618,296, Mar. 18, 1996, abandoned.

[51] Int. Cl.[6] ..... B65D 83/00

[52] U.S. Cl. ..... 222/189.1; 222/211; 222/321.4; 222/376; 222/382; 222/383.1; 222/402.18; 222/402.19; 222/464.2

[58] Field of Search ..... 222/189.06, 189.09, 222/189.1, 189.11, 402.1, 321.3, 321.4, 321.7, 321.9, 376, 382, 383.1, 375, 402.18, 402.19, 464.1, 464.2

[56] References Cited

U.S. PATENT DOCUMENTS

| | | | |
|---|---|---|---|
| 2,681,252 | 6/1954 | Tuttle | 222/464.2 X |
| 2,980,342 | 4/1961 | Armour | 222/211 X |
| 3,260,421 | 7/1966 | Rabussier | 222/402.18 X |
| 3,733,013 | 5/1973 | Doyle | 222/402.19 |
| 3,785,537 | 1/1974 | Appleby et al. | 222/382 X |
| 4,019,661 | 4/1977 | Szabo | 222/376 |
| 4,122,979 | 10/1978 | Laauwe | 222/211 X |
| 4,142,652 | 3/1979 | Platt | 222/464.2 X |
| 4,272,257 | 6/1981 | Ellion et al. | 55/38 |
| 4,398,654 | 8/1983 | Pong et al. | 222/402.1 |
| 4,418,846 | 12/1983 | Pong et al. | 222/402.1 |
| 4,529,414 | 7/1985 | Naess | 55/46 |
| 4,530,450 | 7/1985 | Nandagiri | 222/402.1 |
| 4,546,905 | 10/1985 | Nandagiri et al. | 222/464.2 X |
| 4,775,079 | 10/1988 | Grothoff | 222/376 X |
| 5,125,543 | 6/1992 | Rohrabacher et al. | 222/211 |

FOREIGN PATENT DOCUMENTS

| | | | |
|---|---|---|---|
| 810352 | 8/1951 | Germany | 222/464.2 |

*Primary Examiner*—Kevin P. Shaver
*Attorney, Agent, or Firm*—Watson Cole Grindle Watson, P.L.L.C.

[57] ABSTRACT

A dispensing spray container which delivers only liquid whether in the upright or inverted position. A container with an exit port from a storage cavity is fitted with an imperforate dip tube having an open-end located farthest from the exit port to feed the liquid when the container is in the upright position. In circuit with the dip tube is a porous element located nearest to the exit port whose surface conditions are such that when wetted by the liquid will from a force resulting from the liquid surface tension to prevent the gas from passing when the container is in the upright position and which will pass liquid when held in the inverted position.

13 Claims, 4 Drawing Sheets

INVERTIBLE SPRAY DISPENSING CONTAINER

CROSS REFERENCE TO OTHER APPLICATION

This is a continuation-in-part of U.S. patent application Ser. No. 08/618,296, filed Mar. 18, 1996 entitled "An Invertable Spray Bottle" now abandoned.

FIELD OF THE INVENTION

This invention relates to spray bottles or cans for dispensing a liquid in a jet or atomization mode by means of an attached hand pump or by a pressurized gas and, more particularly, to a novel feed structure that, as a result of surface tension forces, allows liquid to be expelled while preventing the flow of gas regardless of the orientation of the container.

BACKGROUND OF THE INVENTION

There are two basic spray bottle or spray can configurations: one employs a hand pump device to draw the liquid up the feed tube (commonly called, "dip tube") and then sprays the liquid out of the exit port; the second employs a pressurized gas to force the liquid up the dip tube and then sprays the contents out when the exit value is actuated. The use of hand pump bottles or pressurized cans to dispense a wide variety of substances such as glass cleaner, paint, perfume, etc. is widespread. Most of these containers have a single dip tube with an open end that extends into the liquid contents to serve as an entrance when the container is held in an upright position. However, when the container is inverted, the dip tube entrance is exposed to gas, and then only gas can be expelled from the container.

There are numerous patents which relate to the design of novel feed structures that can operate in either the fully upright position or the fully inverted position. The teachings of some of these patents are based on using valves that are dependent on the force of gravity to operate. One group (e.g. Grothoff U.S. Pat. No. 4,775,079) employs one or two balls that open or close flow passages depending on the orientation of the container utilizing the force of gravity. The other group (e.g. Ramsey U.S. Pat. No. 3,733,013 employs slugs that open or close flow passages that also utilize the force of gravity. When the bottle is partially inverted so that the open end of the dip tube is not in contact with liquid, but the component of the force of gravity is insufficient to move the ball or slug to unseat the port, the system will expel gas rather than liquid. Because of the difficulty of obtaining an acceptable gas seal with a ball or slug which is held in position by gravity, none of these patents teaches a concept that will operate consistently at orientations between the fully upright or the fully inverted positions. An additional disadvantage of these concepts is the relatively high cost of the valve.

Another group of patents describes dip tube configurations that will pass some types of fluids but not others. These concepts do not require valves to control the flow into the dip tube. One type is for dispensing a three-phase system wherein phase I is a gaseous propellant and phases II and III are two immiscible liquids. In these patents, a dip tube is described that allows one phase of material to pass but prevents the entrance of another phase. In particular, Pong et al (U.S. Pat. No. 4,418,846) describes two immiscible liquids, one of which is a lipophilic phase and the other is a non-lipophilic phase. The dip tube has an open end through which the non-lipophilic phase flows and a tubular structure formed of a lipophilic material having multi-directional pores through which the lipophilic phase flows. The lipophilic liquid is thereby combined with the non-lipophilic liquid and the combination is passed through the valve means and is dispensed through the valve. Pong et al (U.S. Pat. No. 4,398,654) describes a similar dip tube with an open end through which can pass an aqueous liquid and a tubular structure through which a non-aqueous liquid will flow. There are no claims or description of any inverted operation since these structures operate satisfactorily only if the container is in an upright position. They are mentioned here only because the structures pass one type of fluid but will not pass another.

Nandagiri U.S. Pat. No. 4,546,905 describes an aerosol dispensing device having a porous dip tube that also is closed with the same porous material at the bottom entrance that, in a conventional dip tube, is normally open. The specification contains only a vague description of the operation of the device since it does not include any examples of pore sizes or any method for determining the desired pore size. Also it makes no mention of the percentage of pores (i.e. the ratio of void area to the solid wall area) or the critical dimensions of the porous dip tube (i.e. length, diameter, wall thickness). Since the specification is devoid of any teachings for determining these properties, it is not possible to evaluate the concept precisely. However, it is possible to determine the general performance that could be expected from the dip tube that is fabricated with porous material and that has the bottom entrance also covered with the porous material. While the system may operated satisfactory in the upright and inverted positions when the container is completely full of liquid, it will dispense only gas in either the upright or the invert position when the container is only partially full of liquid. The result is that a large percentage of the original contents of the container can not be dispensed. This problem, very likely, is the reason that the invention has not been in commercial use. The cause and the solution to this problem will be made clear from the teachings of this specification.

There is yet another patent which is of interest in the teaching of the present patent. This patent (Naess U.S. Pat. No. 4,529,414) describes a design for the separation of gas from a liquid in a flow system having at least one permeable blocking layer so arranged along the length of the pipe that the liquid remains on the underside of the blocking medium. This system relies on surface tension and capillary forces to separate the gas from the liquid. It is of interest only because it employs surface tension forces to separate the gas and liquid since it is not related to spray bottles in any manner.

There are several patents for propellant feed systems that operate in zero or near zero gravity fields. Ellion et al (U.S. Pat. No. 4,272,257) is typical of these patents which rely on surface tension to allow liquid to flow and prevent the discharge of gas. Ellion describes a system that has numerous entrances all of which are covered with porous material. A summary article for these zero-gravity rocket motor feed systems is given in the Journal of Spacecraft and Rockets Vol. 8 No. 2 Feb. 1971 pages 83–88 by S. Debrok. Although these patents employ surface tension devices to prevent gas from leaving the container, none of them relates to spray bottles that operate in a gravity field and they all require multiple, complex, expensive porous material to cover all of the numerous entrances.

It is a principal object of this invention to provide a feed system for a hand held spray bottle that is usable when the bottle is at any orientation.

It is another object of this invention to provide a feed system that operates automatically without requiring manipulation on the part of the user.

It is yet another object of this invention to be able to operate this container feed system on earth and consequently in a gravity field or at any gravity level above or below earth's gravity level.

It is still another object of this invention to have no moving parts which would increase the complexity or cost of the feed system.

It is yet another object of this invention to have the capability to dispense the entire contents of the container.

It is a further object of this invention to provide a feed system that requires only a single porous entrance port in addition to the open dip tube entrance port.

It is still another object of this invention to provide a simple, inexpensive feed system that requires little or no added assembly steps over those required for the existing conventional spray bottles.

Other objects and advantages of this invention will become apparent from the following specifications and appended drawings.

BRIEF DESCRIPTION OF THE INVENTION

This invention is directed to a liquid separation feed structure wherein surface tension forces allow liquid to be expelled from a container regardless of its orientation. The feed structure has two openings. The first is the conventional opening at the bottom of the dip tube to admit liquid during upright operation. The second opening is located near the top of the dip tube. The term "top" meaning its upper extremity when the bottle is in its upright position. The material that covers this second entrance port of the feed system contains numerous small pores which, when wetted by the liquid, provide a surface tension force that prevents gas from entering when operating in the upright position, but will pass the liquid freely when operating in the inverted position. Five embodiments are described: large diameter porous insert at the exit end of the conventional dip tube that is fabricated of the porous material; and four embodiments of a porous member in the hand pump, valve in the case of the pressurized can or neck of the bottle in the location where the dip tube attaches. The maximum size of circular pores in the three embodiments is given in the extreme as four times the surface tension of the liquid divided by the atmospheric pressure in the container with a hand pump. For the pressurized aerosol can configuration, the maximum pore size is equal to four times the liquid surface tension divided by the difference between the gas pressure and one atmosphere. For rectangular pores, the smaller dimension is given as two times the surface tension divided by the specified pressures, the size of pores having other shapes falls between these two valves.

The above and other features of this invention will be fully understood from the following detailed description and the accompanying drawings, in which:

DETAIL DESCRIPTION OF THE INVENTION

The application of this invention to hand pump spray bottles will first be described.

Figure 1:
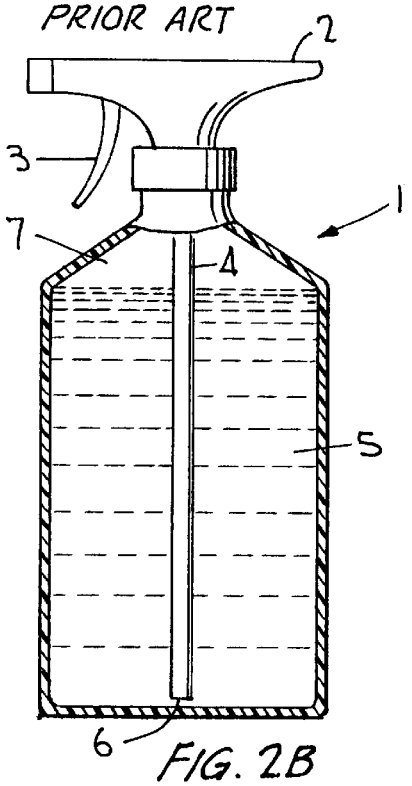
FIG. 1 PRIOR ART
FIG. 1 is a side view partly in cutaway cross-section showing a conventional prior art hand pump spray bottle.

FIG. 1 illustrates a conventional spray bottle 1 with an existing conventional hand pump 2. The conventional hand pump 2 has a trigger 3 that controls the volume of a cylinder (not shown) in the pump. The internal passage of the dip tube 4 is connected to the cylinder and has one end 6 open in order to admit the liquid 5. When the cylinder volume increases, the pressure within it decreases, causing liquid 5 to flow by the pressure force of the air 7 into the open end of the dip tube 6 and through the internal passage into the cylinder. When the cylinder volume is decreased, the pressure of the liquid within it increases and forces a valve (not shown) that connects the cylinder to the dip tube to close. It also forces a spring loaded exit valve (not shown) to open and expel the liquid. Atmospheric air 7 is admitted through an inlet (not shown) in the hand pump to replace the liquid volume that is dispensed. Thus, the air in the container remains substantially at uniform pressure. This conventional hand pump functions well if the open end 6 of the dip tube 4 is in contact with the liquid 5. However, if the open end 6 of the dip tube 4 is not in contact with the liquid 5, as would occur if the bottle is inverted, only gas 7 could be expelled.

Figure 2A:
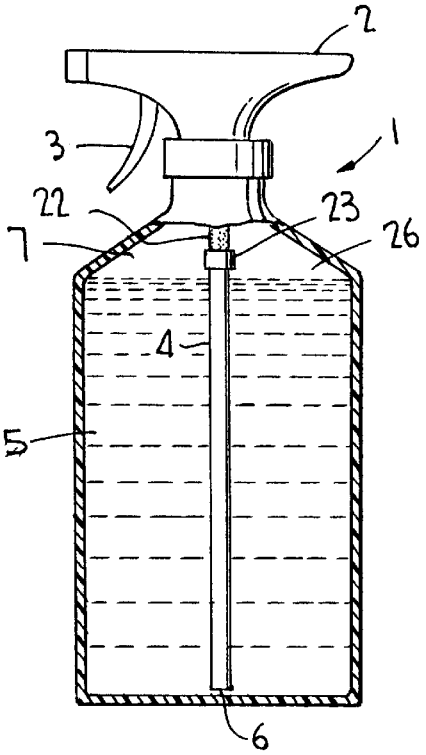
FIG. 2A is a side view partly in cutaway cross-section showing a porous tube connected to a conventional dip tube.
Figure 2B:
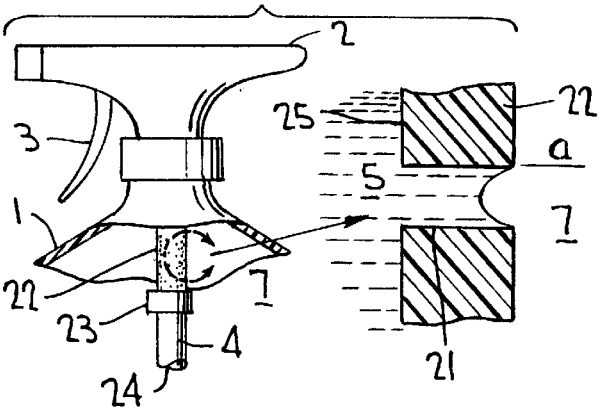
FIG. 2B illustrates a cross-section of the porous tube when the container is held in an upright position.
Figure 2C:
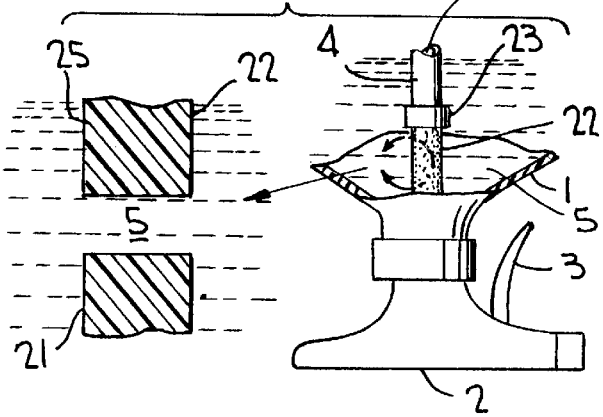
FIG. 2C illustrates a cross-section of the porous tube when the container is held in an inverted position.

Before the detailed operation of this invention can be fully understood, it is necessary to explain how the surface tension can allow liquid to pass through a pore while preventing the passage of gas. By way of example, consider the container and dip tube of FIG. 1 as modified in FIG. 2A where the conventional dip tube 4 having an internal liquid flow passage 24 is connected to a porous tube 22 having an internal liquid flow passage 25 which in turn is connected to the entrance to the hand pump 2. FIG. 2A illustrates the dip tube 4 with the porous tube 22 connected to it by any conventional coupling 23 near the exit to the container. FIG. 2B illustrates a section of the wall of the porous tube 22 when the container 1 is held upright. The sketch illustrates the condition where liquid 5 has been drawn into the internal flow passage 25 of the porous tube 22 by action of the hand pump 2 and the container is in an upright position so that gas 7 in the container 1 is on the outside of the porous tube 22. For simplicity, only one pore 21 of a multitude of pores is illustrated and the section of the porous wall 22 is shown greatly enlarged. FIG. 2C illustrates the same portion of the porous tube 22 when the container 1 is held in the inverted position so that liquid 5 is in the flow passage 25 on the inside of the porous tube 22 and also is on the outside of the porous tube 22.

For simplicity of explanation, consider the pore 21 in the porous tube 22 to the circular in cross section. The liquid will form a contact angle, "a", with the pore material as shown in FIG. 2B that depends on the wettability of the liquid to the pore material. Most commercial detergents and the liquids in spray bottles will wet the plastic porous material so that the contact angle is very close to zero and the cosine can be taken as equal to one. As a result the wetting angle can be eliminated in any calculation. The contact angle is included in the following calculation merely to be complete.

The gas will no enter the pore as long as the force of the gas against the liquid in the pore is less than the force that resists the entrance of the gas which is made up of the liquid pressure and the surface tension of the liquid. Considering the force balance, it is seen that the gas pressure force ($P_g$×cross section area of the pore) must be less than the sum of the liquid pressure force ($P_l$×cross section area of the pore) plus the surface tension force (surface tension×the circumference of the pore).

$$P_g(\pi D^2)/4 \leqq P_l(\pi D^2)/4 + Ds \text{ Cos } a \quad (1)$$

Equation (1) can be rearranged to give the maximum pore size diameter that will prevent the gas from entering the wetted pore:

$$D \leqq (4s \text{ Cos } a)/(P_g - P_l) \quad (2)$$

For any hand pump, the minimum liquid pressure is greater than zero during the perfect suction stroke. If the suction pressure of a particular hand pump is not known, the required size of the pore can be estimated by assuming that, in the extreme, the liquid pressure is zero. Thus the pore size would be given by equation (3) with the value of the liquid pressure set equal to zero i.e. a perfect vacuum.

The above analysis was valid for circular pore shapes. Using the same criteria that was used to develop equation (2) (i.e. that the force produced by the gas pressure must be less than the sum of the forces produced by the liquid pressure and the surface tension), it is seen that the smaller side of the rectangular pore "w" must be smaller than two times the surface tension divided by the difference in pressure between the gas and the liquid at any given pore. This follows since the force produced by the gas pressure on the pore having a width w and a length l ($P_g$×l×w) must be less than the forced produced by the liquid at the pore ($P_g$×l×w) plus the surface tension force (s×21×2w). Assuming that the shorter dimension is much smaller then the longer dimension and rearranging the terms gives a similar relation to equation (2) with the factor "4" replaced with "2".

The actual shape of the pores in commercially available porous material is not circular but is rather elongated voids. A shape between a rectangle and a circle is a good approximation. Experiments have shown that the pore size can be estimated by assuming that half of the pores are close to circular in shape and half are close to rectangular in shape or that the factor "4" for circular pores and the factor "2" for rectangular pores is replaced with the factor "3".

$$D \leqq (4s/P_g) \text{ Cos } a \quad (3)$$

For the case of a pressurized aerosol can, the minimum liquid pressure in the extreme case would be atmospheric pressure $P_g$. Thus the safe pore diameter is given by placing $P_l$ equal to $P_g$ in equation (2) to become:

$$D \leqq [4s/(P_g - P_a)] \text{ Cos } a \quad (4)$$

Equations (3) and (4) define the extreme sized pores that are needed to allow liquid to flow through the pores but prevent any flow of gas. It is seen that if the pressure of the liquid is not at the extreme low values assumed above, the pore sizes could be larger than specified in equations (3) and (4).

The extreme size pores that are determined with equations (3) and (4) are considerably smaller than the size that is actually required for proper operation since the suction pressure of the hand pump is much greater than zero. The following example will illustrate the actual size of pores that are required in order the properly dispense the liquids.

Equation (2) states that the diameter of the circular pore (when wetted so that the contact angle is equal to zero) must be smaller than four(4) times the surface tension of the product being dispensed divided by the value of the gas pressure that is acting on one side of the pore (outside surface of the porous tube) minus the liquid pressure on the other side of the pore (inside surface of the porous tube). When the system is not operating and the container is held in an upright position, the pressure of the liquid ($P_l$) on the inside of the porous tube at any specific pore is equal to the pressure of the gas ($P_g$) on the outside of the tube minus the product of the liquid density (d) and the height (h) of the specific pore above the liquid level in the container, as is known from standard hydraulics ($P_l$=$P_g$−dh). When the system is dispensing the product, the liquid pressure on the inside of the porous element decreases during the suction stroke. It is this lower liquid pressure that must be employed in the calculation using equation (2). An example will be instructive.

Figure 3:
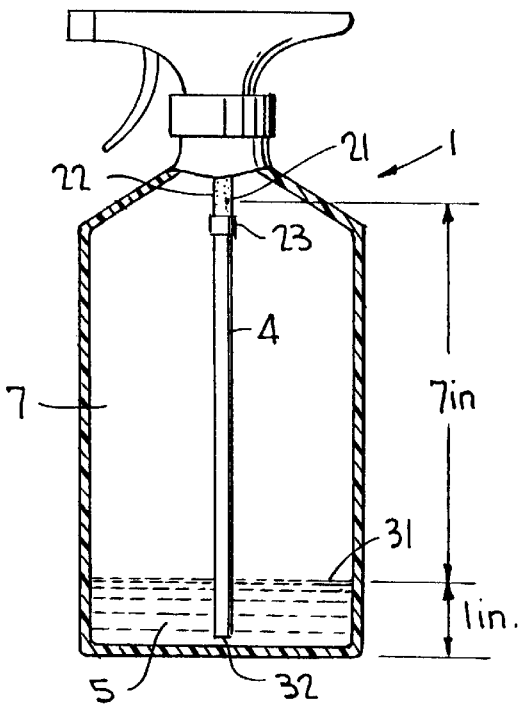
FIG. 3 is a side view partly in cutaway cross-section showing the container with the porous tube attached to a dip tube when the container is held upright with only one inch of liquid contents remaining in the container.

A typical hand pump spray bottle 1 contains a height 26 of five inches of liquid product 5 when upright and is full to capacity as illustrated in FIG. 2A. For simplicity of example, consider that the product to be dispensed is water 5 and the typical bottle 1 is full to capacity. In this case the pressure of the water 5 inside the porous element 22 is very close to the pressure of the air 7 within the container 1 since the porous element 22 is located approximately at the same level as the water level when held upright. A more meaningful example would be the condition when the container 1 is almost empty and the level 31 of the liquid 5 is only one inch when held upright as illustrated in FIG. 3. In this case consider a single pore 21 that is seven inches above the liquid level. The water pressure at the pore 21 is equal to the gas pressure (14.7 psi) minus the distance between the pore and the water level (7 in.) times the water density (0.0361 lb/cu. in.) when not operating the pump 2 and the container 1 is held in an upright orientation [14.7−(7×0.0361)=14.41 psi.]. In order to calculate the required pore size, we must know the pressure during the suction stroke of the pump. From experimental measurements of the most common hand pumps (Continental Sprayers in St. Peters, Mo. and AFA in South Carolina) the typical hand pump with typical dip tubes cause the pressure to drop approximately 0.3 psi during the suction stroke. As a consequence, the required pore size for this example would be equal to or less than four (4) times the surface tension of the water (0.000414 lb/in) divided by the difference between the gas pressure (14.7 psi) and the liquid pressures at the pore (14.41−0.3) or the pore diameter must be equal to or less than the value (4×0.000414)/[14.7−(14.41−0.3)]=0.00281 in. It is seen that a pore size of 0.00281 in. diameter will prevent air from entering the porous tube and will allow liquid to be dispensed when there is one inch of liquid remaining. In order to empty the entire contents of the container, the pore diameter must be slightly smaller as can be determined by replacing the seven inch height with eight inch height in the calculation.

FIG. 2C illustrates a segment of the porous wall that is wetted with liquid on both the interior and exterior of the entering port segment when the container is inverted. It is seen that there is no liquid-gas interface so that there is no surface tension force and the liquid can flow freely through the pore, being slowed only by the surface friction of the pore wall.

Figure 4:
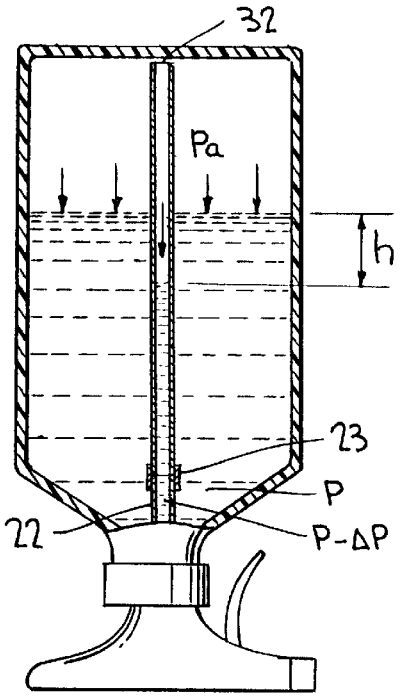
FIG. 4 illustrates the liquid levels when operating in the inverted position during the pump suction stroke.

When the bottle is inverted, the liquid within the dip tube and the porous tube falls to the same level as the liquid in the bottle when the hand pump 2 is not activated. When the hand pump 2 is activated as illustrated in FIG. 4, the liquid flows from the interior of the dip tube 4 and the porous tube 22 to the pump 2 and this quantity of liquid, initially, is only partially replaced by the liquid flow through the wall of the porous tube 22. The result is that the liquid level in the dip tube 4 and the porous tube 22 falls. The liquid level continues to fall until the pressure within the porous tube is low enough to allow the same quantity of liquid to enter the tubes as is dispensed. If the flow were steady rather than pulsing as is the case with the hand pump operation, the liquid in the tubes would fall an amount equal to the quantity "h" as specified by equation (5) and determined by standard fluid mechanics analysis:

$$h=\Delta P/d \tag{5}$$

Where: ΔP is the pressure drop of the liquid as it flows through the porous wall d is the density of the liquid Since the hand pump is activated intermittently, the liquid in the tubes will fall slightly less than specified by equation (5) since some additional liquid enters the porous tube during the positive stroke of the hand pump when no liquid is being drawn from the tubes. However, the hand pump is normally stroked relatively fast so that the liquid level determined by equation (5) is very close to the actual value.

There must be more than a single pore in order to obtain the desired flow rate through the porous tube when the container is operating in the inverted position. For a porous tube made up of pores having diameters of approximately 0.003 inch, a flow area of approximately one square inch is needed to produce the desired flow rate when in the inverted position as has been determined by experiments with various porous tubes and typical hand pump spray bottles. Since it is not possible to have the porous tube entirely made up of pores with no solid material, only a percentage of the wall can be porous. Fifty (50) percent pore volume or empty space in the material is easily attainable by the porous material manufacturers and experiments indicate that this pore volume functions well. The result is that the fifty percent porous tube should have a total area of two (2) square inches in order to provide the one square inch of flow area that is needed to dispense the product at the desired flow rate. If the required pore size is smaller because the liquid product has a lower surface tension or a stronger hand pump having a lower suction pressure is employed, the flow area would have to be increased inversely with the pore size and directly with the pressure difference.

Test with typical spray bottles and hand pumps with a porous wall having pore diameters of 0.003 inch, fifty percent porous and a total area of two square inches have shown that the liquid level for water drops an amount, h, equal to ½ inch during the inverted operation. This result shows that for a one square inch flow area the last ½ inch of water can not be pumped out of the bottle when operated in the inverted position since air begins to be ingested into the pump. It should be noted that all of the liquid can be pumped out of the container in the upright position as long as the open end 6 of the dip tube 4 is in contact with liquid.

Experiments were conducted with a porous tube that has approximately the same diameter as a typical dip tube. A typical dip tube has an internal diameter "D" of 0.1 inches. In order to get the one square inch of flow area with the fifty percent porous tube, the length of the tube that is exposed to the liquid must be over six inches (length=2 sq. in./πD=6.37 in.).

As is suggested by standard fluid mechanics and was verified by experiments, the pressure drop through the porous wall would vary approximately as the square of the flow velocity. For example, if the flow area were decreased by a factor of two, the flow velocity would increase by a factor of two and the pressure drop would increase by a factor of four.

It has been discussed previously that experiments have shown that a porous tube having 0.003 in. diameter pores and is covered by liquid for a total area of two square inches will cause the liquid in the tube to fall one-half inch during inverted operation. As a result, it is seen that a porous dip tube having an internal diameter of 0.1 inches and covered by liquid for a length of 6.37 in. will have a total area of two square inches covered with liquid (total area=π×0.1×6.37=2.00 sq. in.) and will cause the liquid within the tube to fall one-half inch below the liquid in the bottle when operated in the inverted position. The flow area would decrease from the two square inches to only 0.857 sq. in. when the liquid covers only 2.73 inches of the porous tube. It will be instructive to determine the result when the liquid level falls to the 2.73 in. level and covers a total porous wall area of 0.857 sq. in. (π×0.1×2.73=0.857 sq. in.). From the above discussion that the pressure drop varies inversely with the square inches, the liquid in the tubes would fall an amount equal to 2.73 in. [$\frac{1}{2}\times(2^2/0.857^2)$=2.73 in.]. Since there was only 2.73 inches of liquid covering the porous tube and the liquid within the porous tube falls an equal amount, air would enter the hand pump and no liquid can be dispensed. It is seen that the 0.1 in diameter porous tube will not be able to dispense the last 2.73 inches of liquid when the container is operated in the inverted position. This amounts to almost fifty percent of the original capacity of the bottle and would be highly undesirable. For later use, it is convenient at this time to calculate the pressure drop through the porous tube when operated in the inverted position with 2.73 inches of liquid in the container. Using equation (5), the pressure drop through the porous tube can be determined as 0.099 psi since it is known that the liquid fell 2.73 inches (ΔP=d×h=0.036×2.73=0.099 psi).

This problem of not being able to dispense a large portion of the product from the container with a small diameter porous tube is one of the reason that Nandagiri U.S. Pat. No. 4,546,905 has not been used in commercial containers. A second problem with U.S. Pat. No. 4,546,905 is that a large percent of the liquid also can not be dispensed in the upright position because the bottom entrance to the porous tube is covered also with the porous material and thus impedes the flow of liquid. The cause and solution to this problem will be made clear in the following discussion.

If this bottle were operated in the upright position and the liquid level remained at 2.73 inches, the pressure drop through the porous wall would again be very close the 0.099 psi that was calculated previously for the inverted operation. The reason for the similarity is that the flow area through the end of the porous tube is also covered with the porous material and is very small compared to the side wall area of the tube. The result is that the liquid pressure inside of the porous tube is reduced and additional 0.099 psi during operation and, consequently, the surface tension can not prevent the gas pressure from forcing the gas into the pores. The pore size must be reduce below the 0.003 in. diameter in order to withstand this lower liquid pressure and, consequently, the flow area must be increased correspondingly. However, since only 2.73 inches of the porous wall is exposed to liquid, the flow area remains constant for a give porous tube diameter and gas will be ingested into the hand pump. It is seen that Nandagiri U.S. Pat. No. 4,546,905 would not be able to dispense a large percent (almost fifty percent) of the original contents of the container in either the upright of the invert positions. The present invention has three major points of difference with the Nandagiri patent in order to eliminate these problems: (1) it has an entirely open entrance for the dip tube so that the flow during upright operation is not restricted, (2) it has a short length of enlarged area for the porous entrance so that pressure drop though the pores is small even with small liquid levels during inverted operation and (3) the porous element is located in the hand pump or in the neck of the container where the cross sectional area is small. The advantages of this invention will become clear in the following discussion along with an explanation of the surprising result that an open ended dip tube can function in the inverted position.

In this example, the circumference and cross-section area are readily derived from the diameter. The same criteria exist for packed spheres, for rectangular weaves, and for other shapes. The circumference (perimeter) will be determined and the cross-section calculated. With these and the knowledge of the surface tension, the necessary sizes can be calculated and the product made accordingly.

Now that the operation of a wettable porous material has been explained, the design of a spray bottle that utilizes the principle can be described. The following description illustrates the application to a hand pump bottle. The discussion is equally applicable to a pressurized aerosol can or a squeeze bottle as will be explained later in this specification.

FIG. 2A illustrated one concept where the conventional dip tube 4 is connected with a length of porous wall 22 having substantially the same internal and external diameters as the conventional tube. The problem encountered with this concept has been explained: i.e. a large percent of the original contents of the container can not be dispensed in the inverted position because of the limited flow area of the porous tube.

Figure 5:
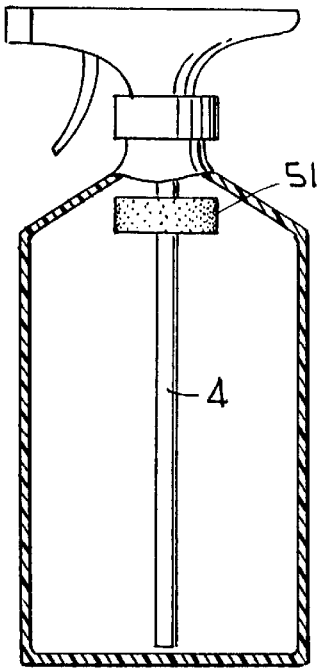
FIG. 5 illustrates a spray bottle with the large diameter porous insert of this invention at the top of the conventional dip tube.

The first embodiment of this invention employs a conventional solid wall dip tube with a conventional open end to admit the liquid to be dispensed when operating in the upright position. A large diameter porous cylinder 51 is connected between the top end of the dip tube and the hand pump as is illustrated in FIG. 5. In this case "top" refers to the position closest to the hand pump which is the upper region of the container when it is held in an upright position. The large diameter porous cylinder 51 provides increased flow area for a given length when the system is operating in the inverted position.

For example, it has been shown that if it is desired to prevent air from being ingested into the hand pump when one-half inch of liquid is covering the porous element when operating in the inverted position, the area of the fifty percent void porous element that is covered with liquid must be equal to two square inches. This is the result since the liquid will fall one-half inch within the porous element during the suction stroke and consequently allow gas to enter the hand pump and prevent further liquid from being dispense. The diameter of the porous cylinder must be 0.74 inches in order to have a surface area of two square inches and a length of one-half inch. FIG. 5 illustrates such a porous cylinder. One problem with this design is that the porous element must have both a porous top and bottom which can not be fabricated in one piece and thus adds cost. Also, there is an additional connection since the top must connect to a tube that connects to the exit. An additional problem with this concept is that one-half inch of liquid can not be dispensed in the inverted position. This quantity of liquid is almost ten percent of the initial capacity of a typical spray bottle. This problem can be overcome by locating the porous element in the hand pump or in the entrance region of some types of spray bottles.

Typical bottles and hand pumps have an internal entrance port diameter of approximately 0.8 inches. The cross-section area inside the pump would be 0.503 square inches ($\pi \times 0.8^2/4=0.503$ sq. in. ). The main body of a typical spray bottle has a cross-section area of approximately eight square inches. Consider the case when the container is in the inverted position, a volume of liquid occupies one-half inch in height when located in the inlet port section of a hand pump that has a cross-section of 0.503 sq. in. This same volume of liquid would have a level of only 0.031 in. when the bottle which has a cross-section area of 8 sq. in, is held in the upright position [$\frac{1}{2} \times (0.503/8)=0.031$ in.]. The conclusion is that, if the porous element is covered with liquid over a two sq. in. surface, there will remain in the bottle one-half inch of fluid when operated in the inverted position. However, this one-half inch of liquid when in the bottle in the upright position will have only a level of 0.031 in. which is less than one percent of the full bottle capacity. It should be noted that the entire contents of the container can be dispensed in the upright position since the end of the dip tube is open and does not restrict the flow of liquid. This remaining amount of product is less than one percent of the full capacity of the bottle and is acceptable since most conventional spray bottles do not dispense more than ninety-nine percent of the contents. The conclusion is that a porous element located within the hand pump having a diameter of 0.8 in. and a height of ½ in. will dispense substantially all of the liquid in the both the inverted and upright positions.

Figure 12:
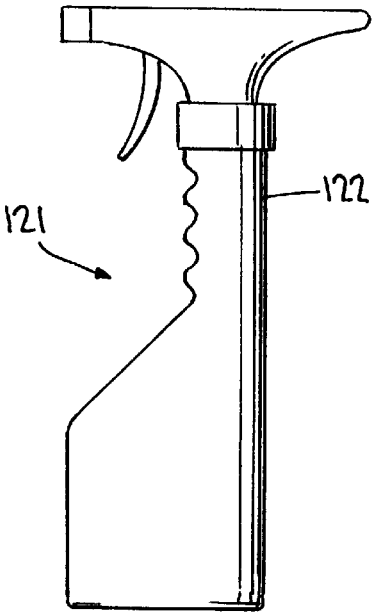
FIG. 12 PRIOR ART
FIG. 12 is an illustration of a conventional long neck spray bottle.

The porous element may also be located in the neck of some bottles to take advantage of a small cross-section. A great many of the hand pump spray bottles (Comet, 409, Windex, etc.) have containers 121 long necks 122 similar to that illustrated in FIG. 12. The reason for the shape is that the bottle may be held more conveniently than the cylindrical bottles. The neck of these bottles has an internal diameter of approximately 0.8 in. and locating the porous element there would have the same advantages as locating the element in the hand pump.

With this preliminary information it is now possible to describe preferred embodiments of this invention.

Figure 6A:
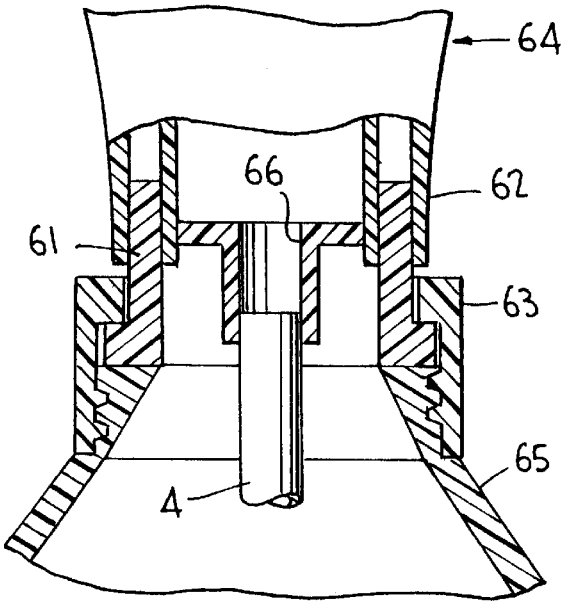
FIG. 6A PRIOR ART
FIG. 6A is a fragmentary axial cross-section of a conventional prior art hand pump.
Figure 6B:
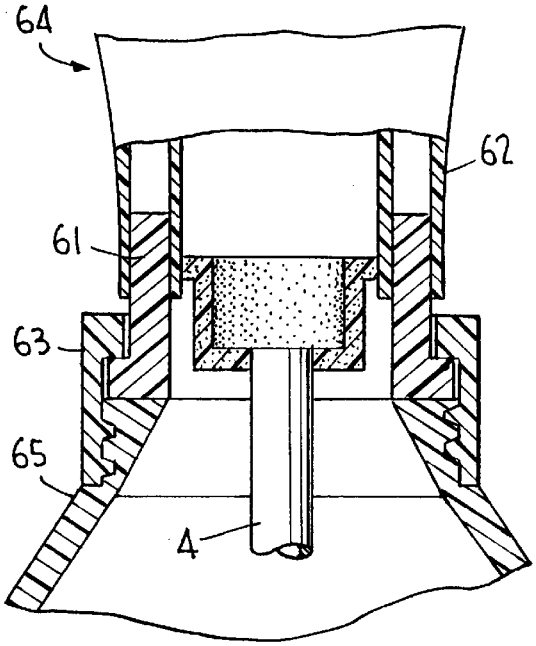
FIG. 6B is a fragmentary axial cross-section similar to FIG. 6A showing an adaptation of this invention.

FIG. 6A illustrates one of many available prior art hand pumps. It can be manufactured and assemble entirely by automatic machines. It is typical of most of the available hand pumps. An insert 61 attaches the nut 63 to the base 62 of the hand pump 64. The nut 63 in turn attaches the hand pump 64 to the bottle 65. A separate insert 66 is pressed into the base 62 of the hand pump 64 so that the dip tube 4 can be attached. FIG. 6B illustrates the same hand pump 64 and the same attachment nut 63 but with the solid insert 66 replaced with a porous insert 67. This porous insert can be fabricated and assembled to the pump at the same cost as the solid insert. The only increase in cost would be the difference in cost between the solid material and the porous material.

Figure 7:
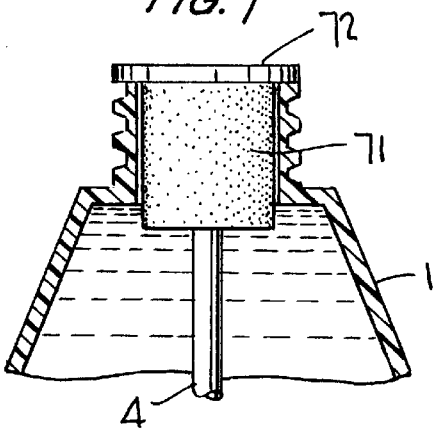
FIG. 7 illustrates a third embodiment of this invention.
Figure 9A:
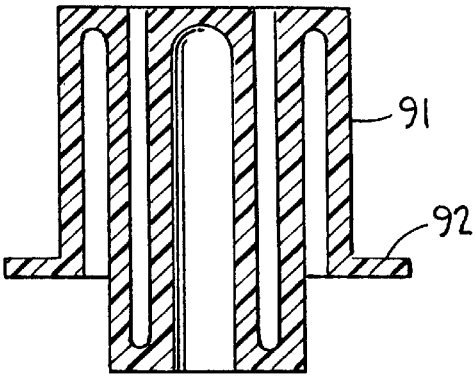

A third embodiment of this invention is illustrated in FIG. 7. The porous element 71 is in the shape of an inverted top hat into which the conventional dip tube 4 is inserted. Instead of having the tube supported by the hand pump, the flange 72 act as a support for the porous element at the entrance to the bottle. The hand pump would attach to the bottle in the unusual manner and retain the porous element in place. In some manufacturing programs, this method of support is less expensive than using the hand pump as a support for the porous element. Alternately, the flange 72 of the porous element 71 can be inserted into the hand pump in the same manner that was illustrated in FIG. 6B for the element 67.

Figure 8B:
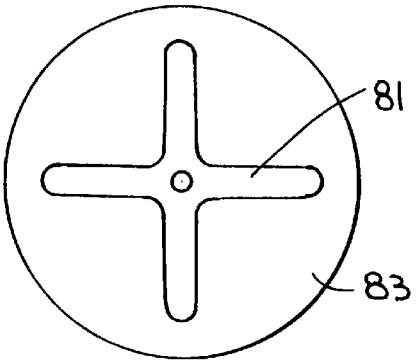
FIG. 8 illustrates a forth embodiment of this invention.
Figure 8C:
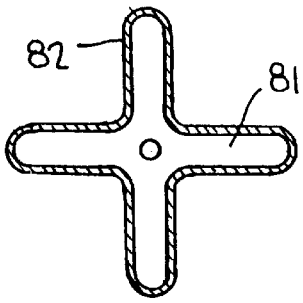
Figure 8A:
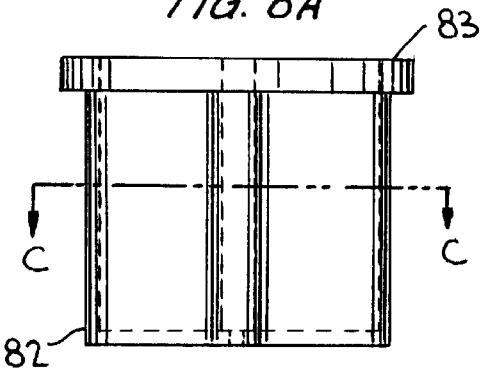

A forth embodiment of this invention forms the porous wall of the inverted top hat into a star shape as illustrated in FIG. 8. Contouring the wall in this manner will provide a greater flow area for a given length of porous element. As a result, during inverted operation, there is a larger flow area for any given liquid level that is covering the porous element. An added advantage of this configuration is that the volume 81 within the porous element 82 is decreased over the inverted empty top hat and thus requires fewer strokes of the hand pump to prime the system in order to start dispensing the product. Several manufacturers of spray material require that no more than three hand pump strokes be required to start dispensing the product. Like the inverted top hat 71, this porous element can be supported at the bottle entrance by the flange 83. Alternately, the flange 83 of the porous element 82 can be inserted into the hand pump in the same manner illustrated for porous element 67 that is illustrated in FIG. 6B.

Figure 9:
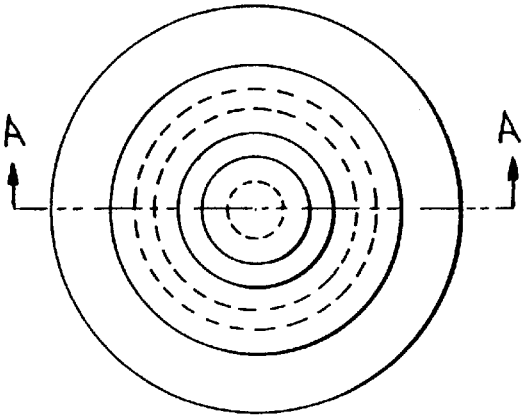
FIG. 9 illustrates a fifth embodiment of this invention.

A fifth embodiment also adds more flow area for a given length of porous element as illustrated in FIG. 9. This accordion shaped wall of the porous element 91 provides the same advantages as the porous element 82 that has a star shaped wall. Similarly, it can be supported by the flange 92 on the bottle entrance or it can be inserted into the hand pump for support in the same manner as the porous element 67 that is illustrated in FIG. 6B.

Figure 10:
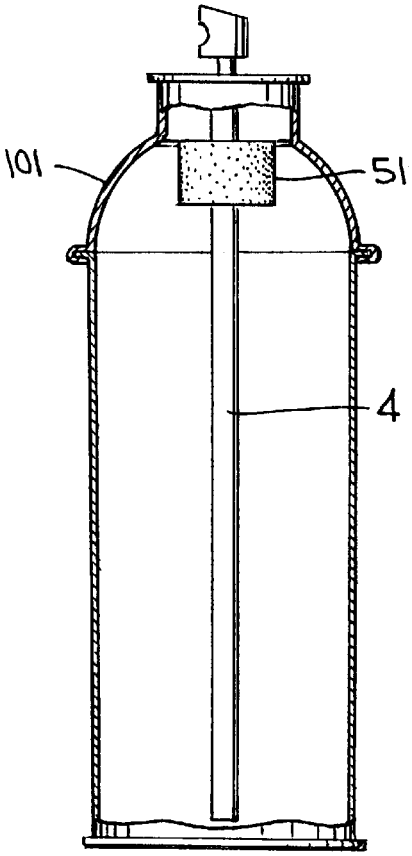
FIG. 10 is a cutaway axial cross section of a pressurized container according to this invention.

The previous discussions has been concerned with a hand pump spray bottle. FIG. 10 illustrates one embodiment of the porous element 51 installed in a pressure aerosol can 101. With slight modifications, all of the previous discussion and analyses for the spray bottle is also applicable to the aerosol can. In this case, the pressure resulting from the atmospheric air is replaced with a pressurized gas (carbon dioxide or nitrogen) or liquid gases (e.g. propane or isobutane). The hand pump suction pressure is replaced with the pressure upstream of the exit valve.

Figure 11:
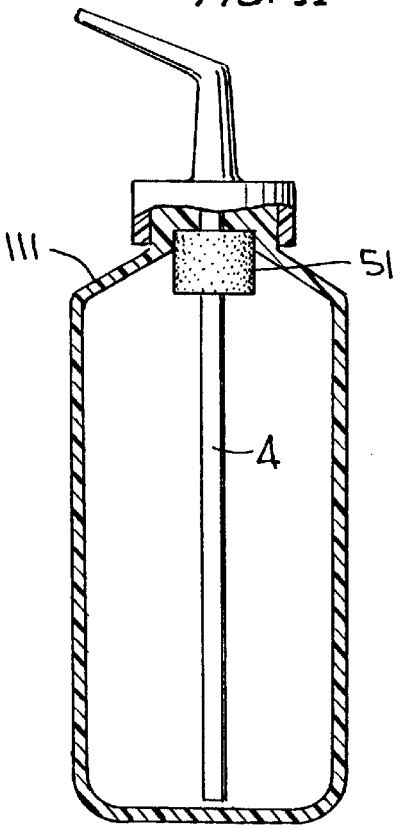
FIG. 11 is a cutaway axial cross section of a squeeze type container according to this invention.

FIG. 11 illustrates on of the embodiments of the porous element 51 installed in a squeeze bottle 111. Again, with slight modifications, all of the discussion on the hand pump spray bottle is applicable to the squeeze bottle. In this case, the air pressure of the spray bottle is replaced with the pressure resulting from squeezing the bottle and the pump suction pressure is replaced with the pressure upstream of the exit port.

The porous material for any of the embodiments can be made from a polymer solution that comprises a solute and a solvent. Polystyrene and polyethylene are suitable examples. As the temperature of the solution is lowered, the solvent will separate from the solute, and small globules of the solvent would be formed. Removal of the solute leaves a suitable porous material. The pore size is controlled by the rate at which the solution is cooled. Some experimentation may be necessary to arrive at suitable process parameters. Any suitable solvent can be used in which the solubility of the polymer decreases with decreasing temperature so that the polymer will precipitate out as it is cooled. This solid material can be shaped by processes such as casting or extruding.

Another method to make a structure with a suitable pore size is to sinter particles together in a body. The interstitial spaces will have known dimensions when particles of known sizes are used. Glass, metal, or plastic particles may be sintered or fused for this purpose.

Several plastic manufacturers routinely fabricate inexpensive porous elements in very large numbers having pore sizes ranging from 5 to 2000 microns (0.000197 to 0.07874 in.) and volume of pores from twenty to sixty percent. Typical uses are for felt tips in marking pens, water filtration and various medical applications. Interflow Technologies, Inc. in College Point, N.Y. and General Polymeric Corp. in Reading, Pa. are two of the larger producers of the sintered porous plastic material.

Another example of a suitable material, multiple layers of a nylon weave, similar to that used in women's hosiery having equivalent pore orifices of about 0.003 inches by about 0.003 inches is suitable for use as the porous material.

There are numerous other processes that will produce the desired porous material that anyone skilled in the art can envision.

It should be realized that the invention will not function properly unless the pores in the one entrance are wetted with the liquid to be expelled. When the bottle is first activated, it should be inverted to allow the liquid to wet the porous entrance and then the hand pump, the exhaust valve, or the bottle will be squeezed to cause the liquid to flow into the pores. The feed system will remain primed indefinitely unless the container is subjected to severe vibrations. Test containers have remained primed for over 25 months in storage after being primed at the start of the test. As a result the priming action need to be performed only once.

Analytical techniques have been taught in this specification on how to determine the pore size and flow area for an invertable spray bottle. It also has been shown that the dip tube must have an open end in order to dispense the entire contents of the container during upright operation. The surprising result of the teachings of this invention over Ellion (U.S. Pat. No. 4,272,257) and Nandagiri (U.S. Pat. No. 4,546,905) is that the device with a single porous entrance having proper pore size and flow are installed in the hand pump or neck of the spray bottle with an open ended dip tube will dispense substantially all of the product from the container in the upright or inverted positions without ingesting gas.

This invention is not to be limited by the embodiments shown in the drawings and described in the description, which are given by way of example and not of limitation, but only in accordance with the scope of the appended claims.

We claim:

1. A spray container for dispensing a liquid, said container having an upright axis, and comprising:

an impermeable boundary wall forming a storage cavity to contain said liquid, said boundary wall having an exit port passing through it from the cavity, said exit port being atop said cavity when the container is in its upright position, said container being adapted to deliver liquid at all orientations of said axis relative to the vertical;

a dip tube extending from said exit port into said cavity, said dip tube having a tubular wall and a central passage in said tubular wall extending from said exit port, said passage having an open end inside said cavity; and porous means in said cavity adjacent to said exit port providing a flow path for liquid from said cavity to said exit port;

said porous means being formed of a material which is wettable by said liquid and having a plurality of pores of such size as will permit the flow through them of said liquid, and when wetted by said liquid will prevent flow of gas through said pores;

whereby, when said container is in said upright position, a lesser pressure outside of said exit port than in said cavity will cause exit of liquid from the cavity through the dip tube and exit port, while the porous means when wetted by the contents prevents exit of gas from the cavity through said porous means, and when the container is inverted, and said pressure difference exists, liquid will be delivered from the liquid in the dip tube and also from liquid that passes through said porous means until the level of the liquid in the dip tube falls by an increment relative to the level of the fluid in the container that is equal to the pressure drop across the porous means divided by the density of the liquid, after which liquid is delivered to the exit port only through the porous means.

2. A container according to claim 1 in which said tubular wall of said dip tube is imperforate, and said porous means is a porous body having an outer surface inside said cavity adjacent to said exit port and an internal passage through it connected to and receiving fluid from said dip tube while in said upright position, and delivering fluid to the exit port while in said inverted position.

3. A container according to claim 2 in which said porous means is a cylinder connected between said exit port and said dip tube for direct flow from said dip tube directly into said internal passage of said porous body and then to the exit port while in the upright orientation and from said cylinder to the exit port while in the inverted position.

4. A container according to claim 3 in which said porous means includes a peripheral flange extending across said exit port.

5. In combination:

a spray container according to claim 1, and a hand pump connected to said exit port to draw liquid from said cavity.

6. A container according to claim 5 in which said tubular wall of said dip tube is imperforate, and said porous means is a porous body having an outer surface inside said cavity adjacent to said exit port and an internal passage through it connected to and receiving fluid from said dip tube while in said upright position, and delivering fluid to the exit port while in said inverted position.

7. A container according to claim 6 in which said porous means is a cylinder connected between said exit port and said dip tube for direct flow from said dip tube directly into said internal passage of said porous body and then to the exit port while in the upright orientation and from said cylinder to the exit port while in the inverted position.

8. A container according to claim 7 in which said porous means includes a peripheral flange extending across said exit port.

9. A spray container according to claim 1 in which said container is rigid and is pressurized with gas to expel liquid from said cavity, and including valve means to maintain pressure in said cavity and to release said liquid.

10. A container according to claim 9 in which said tubular wall of said dip tube is imperforate, and said porous means is a porous body having an outer surface inside said cavity adjacent to said exit port and an internal passage through it connected to and receiving fluid from said dip tube while in said upright position, and delivering fluid to the exit port while in said inverted position.

11. A spray container according to claim 1 in which said boundary wall is flexible so as to be compressible in order to expel liquid from said cavity.

12. A container according to claim 11 in which said tubular wall of said dip tube is imperforate, and said porous means is a porous body having an outer surface inside said cavity adjacent to said exit port and an internal passage through it connected to and receiving fluid from said dip tube while in said upright position, and delivering fluid to the exit port while in said inverted position.

13. A container according to claim 12 in which said porous means is a cylinder connected between said exit port and said dip tube for direct flow from said dip tube directly into said internal passage of said porous body and then to the exit port when while in the upright orientation and from said cylinder to the exit port while in the inverted position.

* * * * *